US012643632B2

(12) United States Patent
Vasilchikov et al.

(10) Patent No.: US 12,643,632 B2
(45) Date of Patent: Jun. 2, 2026

(54) METHOD OF MANUFACTURING A BODY OF A STRUCTURE

(71) Applicant: SV Business Group Inc., West Vancouver (CA)

(72) Inventors: Fedor Vasilchikov, West Vancouver (CA); Maxim Aksenov, West Vancouver (CA); Nikolai Ezhkov, West Vancouver (CA)

(73) Assignee: SV Business Group Inc., West Vancouver (CA)

( * ) Notice: Subject to any disclaimer, the term of this patent is extended or adjusted under 35 U.S.C. 154(b) by 427 days.

(21) Appl. No.: 18/337,730

(22) Filed: Jun. 20, 2023

(65) Prior Publication Data

US 2024/0017796 A1 Jan. 18, 2024

Related U.S. Application Data

(60) Provisional application No. 63/388,942, filed on Jul. 13, 2022.

(51) Int. Cl.
*B63B 3/26* (2006.01)

(52) U.S. Cl.
CPC ..... *B63B 3/26* (2013.01); *B63B 2231/48* (2013.01); *B63B 2231/50* (2013.01)

(58) Field of Classification Search
CPC .... B63B 3/00; B63B 3/14; B63B 3/26; B63B 3/48; B63B 5/00; B63B 5/06; B63B 5/24; B63B 32/00; B63B 32/57; B63B 32/59; B63B 34/00; B63B 34/10; B63B 34/20; B63B 34/21; B63B 34/50; B63B 2231/48; B63B 2231/50

(Continued)

(56) References Cited

U.S. PATENT DOCUMENTS 4,997,707 A 3/1991 Otawa et al.
6,675,734 B2 * 1/2004 Eagles ..... B65D 88/16 383/117

(Continued)

FOREIGN PATENT DOCUMENTS

CN 202201153 U 4/2012
CN 205417779 U 8/2016

(Continued)

OTHER PUBLICATIONS

Aref, et al., "Advanced Composite Panels for Seismic and Vibration Mitigation of Existing Structures,"Journal of Engineering Materials and Technology, 2006, vol. 128 (6), pp. 618-632.

(Continued)

*Primary Examiner* — Daniel V Venne
(74) *Attorney, Agent, or Firm* — Borden Ladner Gervais LLP; Geoffrey dekleine

(57) ABSTRACT

A method of manufacturing a body of a structure includes arranging a plurality of foam components of the body such that each one of the foam components abuts at least one other of the foam components to form a shape. The method also includes applying polyurea along intersection lines of the foam components and covering a surface of the shape, thereby bonding the components together and providing a composite material forming the body of the structure.

20 Claims, 7 Drawing Sheets

(58) Field of Classification Search
USPC .... 114/343, 347, 352, 355, 357, 65 R, 77 R, 114/77 A, 84, 85, 88; 441/65, 74
See application file for complete search history.

(56) References Cited

U.S. PATENT DOCUMENTS

| | | | | |
|---|---|---|---|---|
| RE41,851 | E * | 10/2010 | Heinz | B32B 27/065 254/88 |
| 8,701,585 | B1 * | 4/2014 | Seaman | C09D 175/02 114/357 |
| 10,125,230 | B2 * | 11/2018 | Prissok | C08J 9/0085 |
| 2007/0045886 | A1 | 3/2007 | Johnson | |
| 2009/0090236 | A1 | 4/2009 | Misencik et al. | |
| 2011/0277298 | A1 | 11/2011 | Zeller | |
| 2014/0216326 | A1 | 8/2014 | Driscoll | |
| 2018/0002939 | A1 | 1/2018 | Harve et al. | |

FOREIGN PATENT DOCUMENTS

| | | | | |
|---|---|---|---|---|
| CN | 110697206 | A | 1/2020 | |
| CN | 111216422 | A | 6/2020 | |
| CN | 111232374 | A | 6/2020 | |
| DE | 102018105921 | A1 * | 9/2019 | B63B 5/24 |
| WO | 0209929 | A1 | 2/2002 | |
| WO | 2018064870 | A1 | 4/2018 | |

OTHER PUBLICATIONS

Mella, C.R.J., "Dynamic Behavior of Composite Structures Subjected to Aggressive Marine Environments: an Experimental and Computational Investigation,"University of Rhode Island, a Dissertation Submitted in Partial Fulfillment of the Requirements for the Degree of Doctor of Philosophy in Mechanical Engineering and Applied Mechanics, 2019, pp. 24 pages.

* cited by examiner

METHOD OF MANUFACTURING A BODY OF A STRUCTURE

FIELD OF THE INVENTION

The present invention relates to a method of manufacturing a body of a structure, such as a hull of a boat.

BACKGROUND

Strength and impact resistance are often important factors in the manufacture of structures, including structures such as boat hulls.

Boat hulls, for example, are often manufactured using a mold when the layers of fiberglass, resin, and core materials are placed in the mold, which dictates the outer shape of the hull. Several layers of fiberglass and resin are utilized to provide suitable stiffness for such a structure. Some core materials such as balsa, foam or other materials may be included in an effort to provide additional strength with relatively low weight compared to solid fiberglass.

Vacuum infusion methods have been utilized in which the resin is pulled into the mold to provide improved strength of the parts. Such methods, however, require specialized equipment and expertise for manufacturing.

The manufacture of a suitable mold for boat hulls requires significant time and investment. In addition, the boat hull that is built using such a mold is limited in size and shape based on the size and shape of the mold. As a result, there is little flexibility in design and a very high upfront cost of manufacture.

Improvements in the manufacture of such structures are desirable.

SUMMARY

According to an aspect of an embodiment, a method of manufacturing a body of a structure includes arranging a plurality of foam components of the body such that each one of the foam components abuts at least one other of the foam components to form a shape. The method also includes applying polyurea along intersection lines of the foam components and covering a surface of the shape, thereby bonding the components together and providing a composite material forming the body of the structure.

According to another aspect, there is provided a method of manufacturing a hull of a boat. The method includes arranging foam elements including foam cross members, foam stringers, and foam planks into a shape of a hull such that each one of the foam elements abuts at least one other of the foam elements, and applying polyurea along intersection lines of the foam and covering a surface of the shape, bonding the components together and providing a composite material forming the hull of the boat.

According to yet another aspect, a boat hull is provided. The boat hull includes a plurality of foam elements including foam cross members, foam stringers, and foam planks forming a core of a hull with each one of the foam elements abutting at least one other of the foam elements. The foam elements are bonded together utilizing polyurea. The boat hull includes a polyurea skin layer applied over foam elements.

BRIEF DESCRIPTION OF THE DRAWINGS

Embodiments of the present invention will be described, by way of example, with reference to the drawings and to the following description, in which.

DETAILED DESCRIPTION

Figure 1:
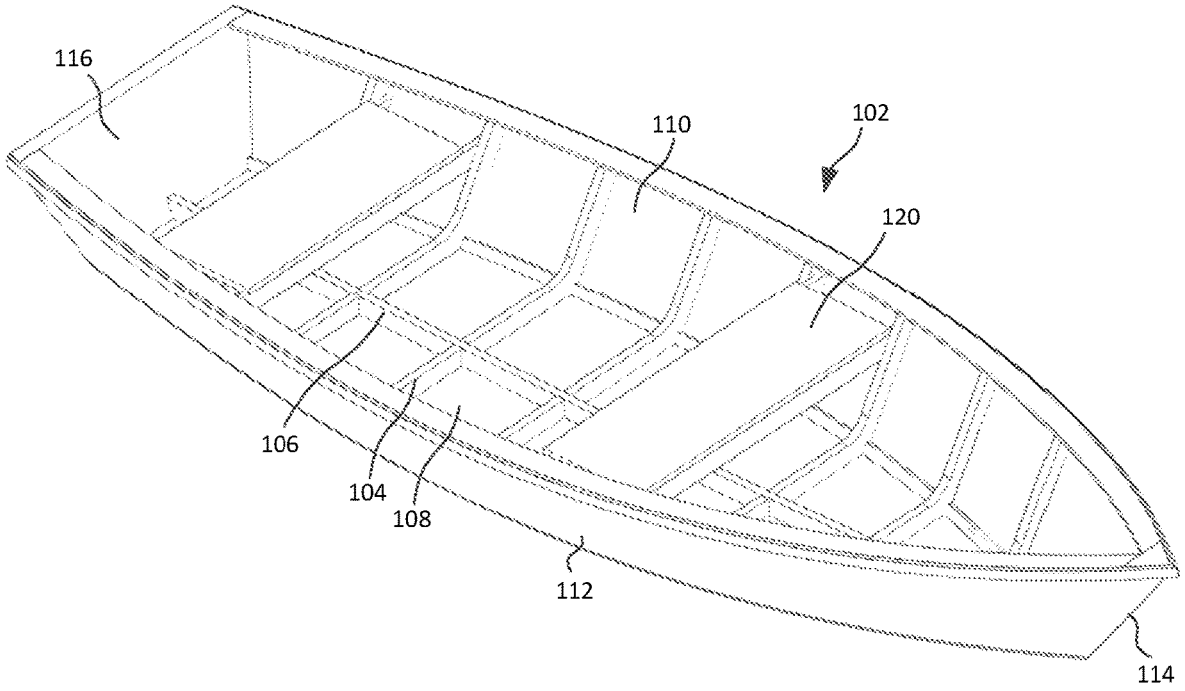
FIG. 1 is a perspective view of an example of a hull of a boat manufactured utilizing a method of manufacturing in accordance with one aspect of an embodiment.

The present disclosure relates generally to the manufacture of a body of a structure. A plurality of foam components of the body are arranged such that each one of the foam components abuts at least one other of the foam components to form a shape. Polyurea is applied along intersection lines of the foam components, covering a surface of the shape, thereby bonding the components together and providing a composite material forming the body of the structure.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Referring first to FIG. 1, an example of a hull 102 of a boat is shown. The hull 102 has a frame that includes cross-members 104 that run generally from side to side, as well as stringers 106 that run generally perpendicular to the cross-members 104. The cross-members 104 and the stringers 106 support the bottom 108 and sides 110, 112 of the hull and provide strength and shape for the hull. In the present example, the sides 110, 112 are shaped to come together at the bow 114 of the boat and are joined together at the stern by a generally flat transom 116 that extends upwardly from the bottom 108 of the boat, between the two sides 110, 112.

The cores of the cross-members 104 and the stringers 106 are foam. Any suitable foam may be utilized. In the present example, the foam is polyvinyl chloride foam. Alternatively, the foam may be polyurethane or expanded polystyrene. The foam of the cross-members 104 and stringers 106 is spray-coated with polyurea, which bonds the foam together and provides a composite material. The polyurea spray coated on the polyvinyl chloride foam provides more than simply a skin layer as the polyurea permeates at least an outer layer of the foam, resulting in composite material with relatively high strength and impact resistance.

The sides 110, 112 of the hull 102 are constructed of foam planks, such as polyvinyl chloride foam, attached to the cross-members 104 and the stringers 106. The bottom 108 of the hull 102 may be constructed of foam that is shaped to fit the bottom 108. Similarly, the transom 116 is constructed of foam that is attached to the cross-members 104 and stringers 106. The foam of the sides 110, 112, the bottom 108, and the transom 116 is spray-coated with polyurea. As with the cross-members 104 and the stringers 106, the polyurea bonds the foam together and provides a composite material as the polyurea permeates at least an outer layer of the foam, resulting in high strength and impact resistance.

In the example shown in FIG. 1, bench seats 120 are added to the boat. The bench seats 120 may be any suitable material and may be added after polyurea spray coating the planks of the sides 110, 112, the bottom, and the transom 116. The bench seats 120 may also be foam with polyurea sprayed to provide composite bench seats 120.

Figure 2:
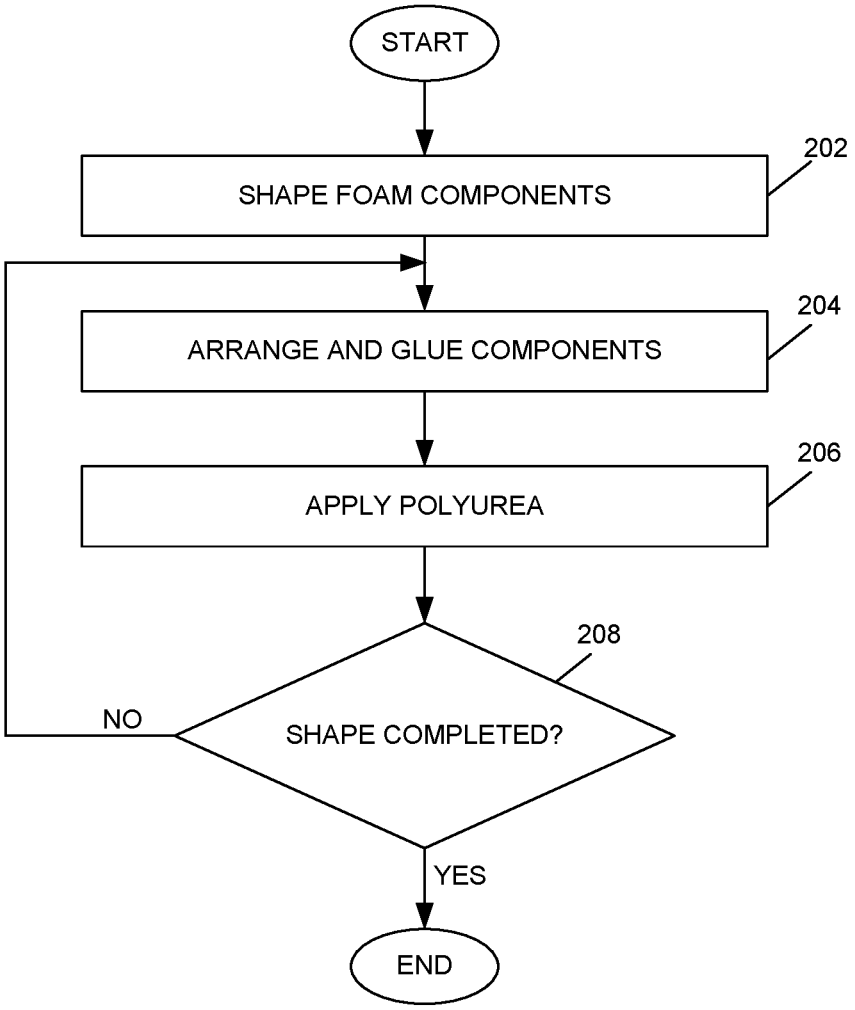
FIG. 2 is a flowchart showing a method of manufacturing a body of a structure in accordance with an aspect of an embodiment.

Reference is now made to FIG. 2 to describe a method of manufacturing a body of a structure, such as the hull 102 of the boat shown in FIG. 1.

In the example shown in FIG. 1, a hull 102 of a boat is shown. The present method may be utilized to manufacture other shapes and sizes of hulls. Further, the present method may be utilized to manufacture other bodies of structures.

As shown in FIG. 2, foam components are shaped at 202. The foam may be, for example, polyvinyl chloride foam. The shape of each of the foam components is dependent on the body and location of the foam component in the body. Each foam component may be shaped in any suitable manner. For example, the foam components may be manufactured by one or a combination of Computer Numerical Control (CNC) machining, saw cutting, hot-wire cutting, and thermoforming.

Each shaped foam component is arranged in the appropriate location and orientation relative to the other foam components such that each foam component abuts at least one other of the foam components to form a shape at 204. In the present example, each foam component is temporarily fixed to each abutting foam component. For example, each foam component may be hot glued to each abutting foam component to temporarily fix the components in their relative positions and locations and thus hold the shape prior to application of polyurea. The hot glue utilized is compatible with the foam polyvinyl chloride foam. A jig or stand may be utilized to facilitate arrangement of the foam components in the appropriate positions and locations to form the body.

Polyurea is then applied to the foam components at 206, bonding the foam components together and covering the surface of the body, providing the composite material forming the body of the structure. As indicated above with reference to FIG. 1, the polyurea spray coated on the foam provides more than simply a skin layer as the polyurea permeates at least an outer layer of the foam, resulting in high strength and impact resistance suitable for bodies such as the hull of a boat.

The polyurea is applied at the intersections of the foam components and is applied to exposed surfaces of the foam components. Optionally, the polyurea may be applied in multiple passes. For example, the polyurea may be applied to one side of the components and, after curing, to an opposite side of the components. Optionally, polyurea may be applied to the intersection lines of the foam components in a first pass, followed by application of the polyurea to the surface of the shape in a second pass.

Polyurea may be applied at 206 before all foam components are arranged relative to the other foam components. For example, a frame of the body may be arranged and glued at 204, followed by application of polyurea at 206 to the frame. The shape of the body is not complete at 208 and the process continues at 204. Additional components, such as the components that form the outer surface of the body are added by gluing to the components that form the frame and to each other at 204. Polyurea is then applied at the intersections of the added foam components and is applied to exposed surfaces of the added foam components at 206.

Thus, the process of arranging the components at 204 and applying polyurea at 206 is repeated until the body is complete at 208 and the process ends.

In the above description and the flowchart shown in FIG. 2, the foam components are all formed before arranging any of the components. It will be understood, however, that some of the foam components may be formed and arranged prior to completing formation of other components.

Reference is now made to FIG. 3 through FIG. 10 with continued reference to FIG. 2 to describe one example of the method of FIG. 2. FIG. 3 through FIG. 10, illustrate the hull 102 of the boat of FIG. 1 at various stages in the method of manufacturing in accordance with FIG. 2.

The foam components that form the hull 102 of the boat are shaped at 202. These foam components may be shaped in any suitable manner as referred to above. The foam components of the hull 102 include the components that form the cross-members 104, the stringers 106, the bottom 108, the transom 116, and planks for the sides 110, 112.

Figure 3:
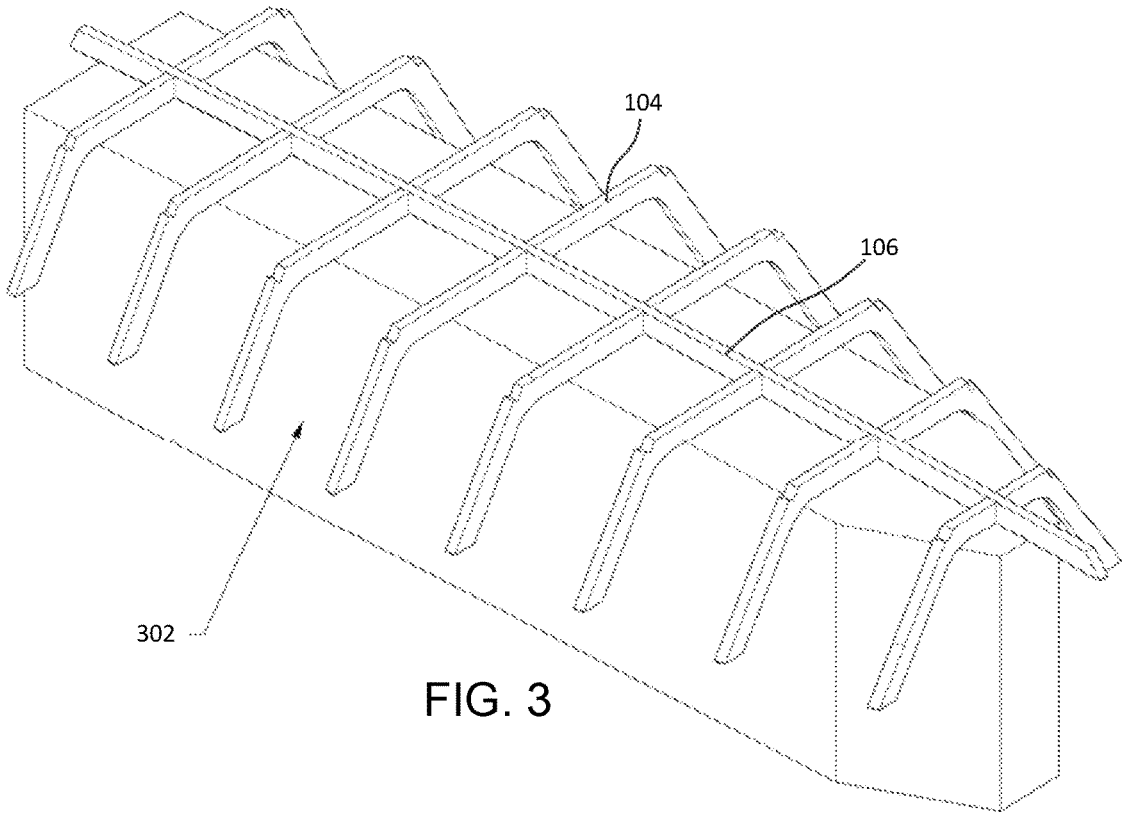
FIG. 3 through FIG. 10 are perspective views of parts of the hull of the boat of FIG. 1 at various stages in the method of manufacturing.

As shown in FIG. 3, the foam components that form the cross-members 104 and the stringers 106 are arranged, at 204, on a jig 302 that is utilized to facilitate arrangement of the cross-members 104 and the stringers 106 in the appropriate positions and locations to form the hull. The foam components that form the cross-members 104 and stringers 106 are hot glued together in the arrangement to temporarily hold these foam components in the shape of the hull.

Figure 4:
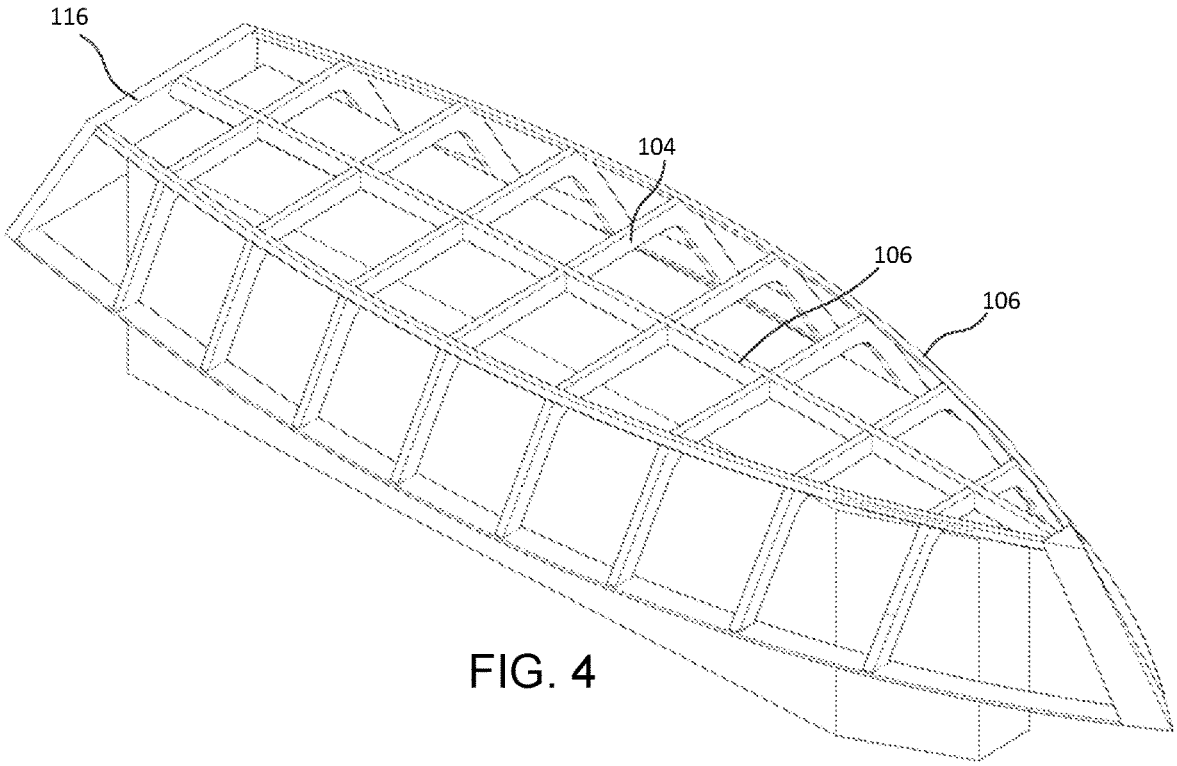

Additional foam components that form further stringers 106 are added as shown in FIG. 4, along with the foam components forming the transom 116.

Figure 5:
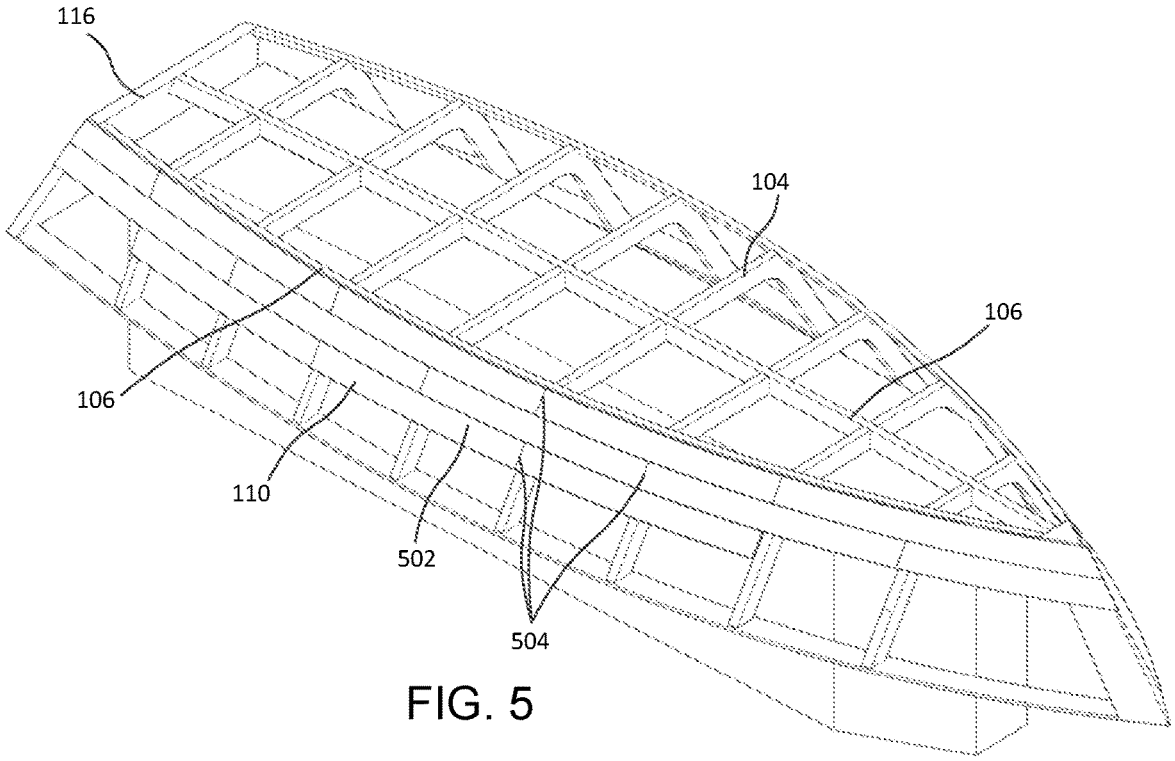
Figure 6:
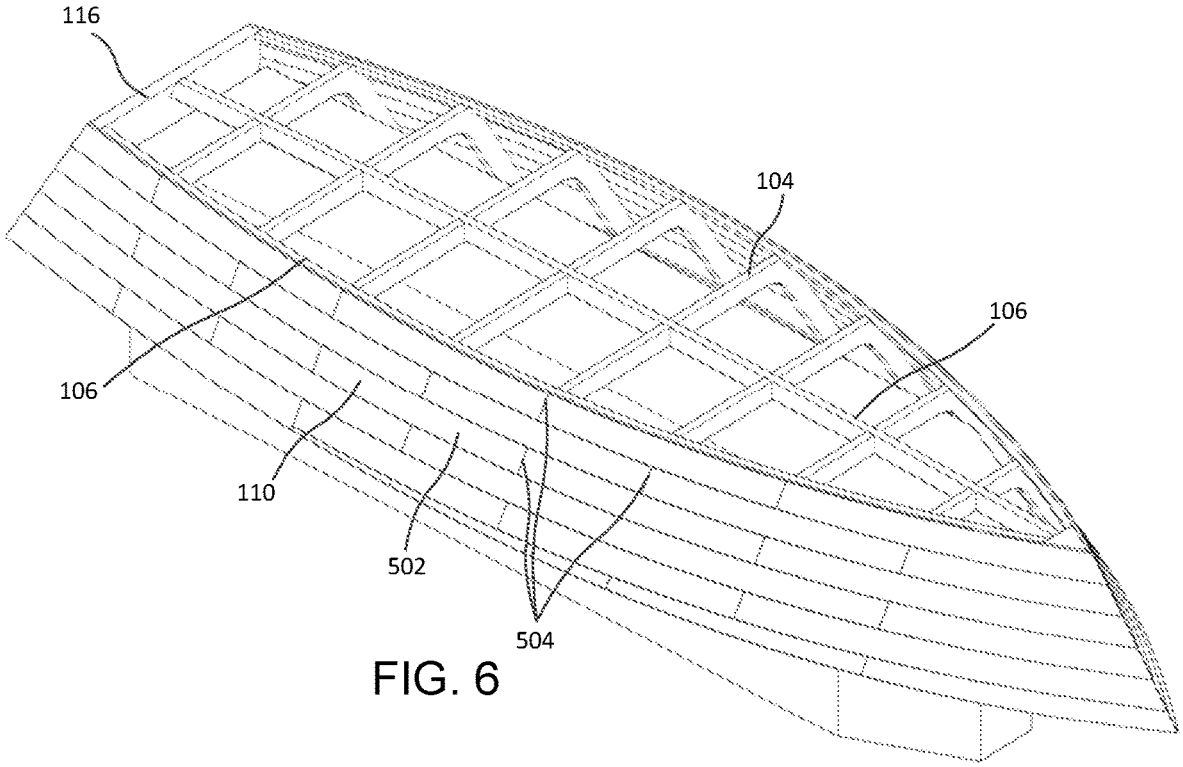

As shown in FIG. 5 and FIG. 6, the planks 502 are added. At 204, the planks 502 are added by arranging the planks 502 on the cross-members 104 and stringers 106. The foam planks 502 form the core of the sides 110, 112, which form an outer surface of the hull 102. As illustrated in FIG. 5 and FIG. 6, the ends 504 of the planks 502 are staggered along the length of the sides 110, 112. Thus, the ends 504 are not aligned with each other. This staggering of the ends 504 of the planks 502 is carried out to reduce the number of continuous, linear joints extending the from the bottom to top of the sides 110, 112.

Figure 7:
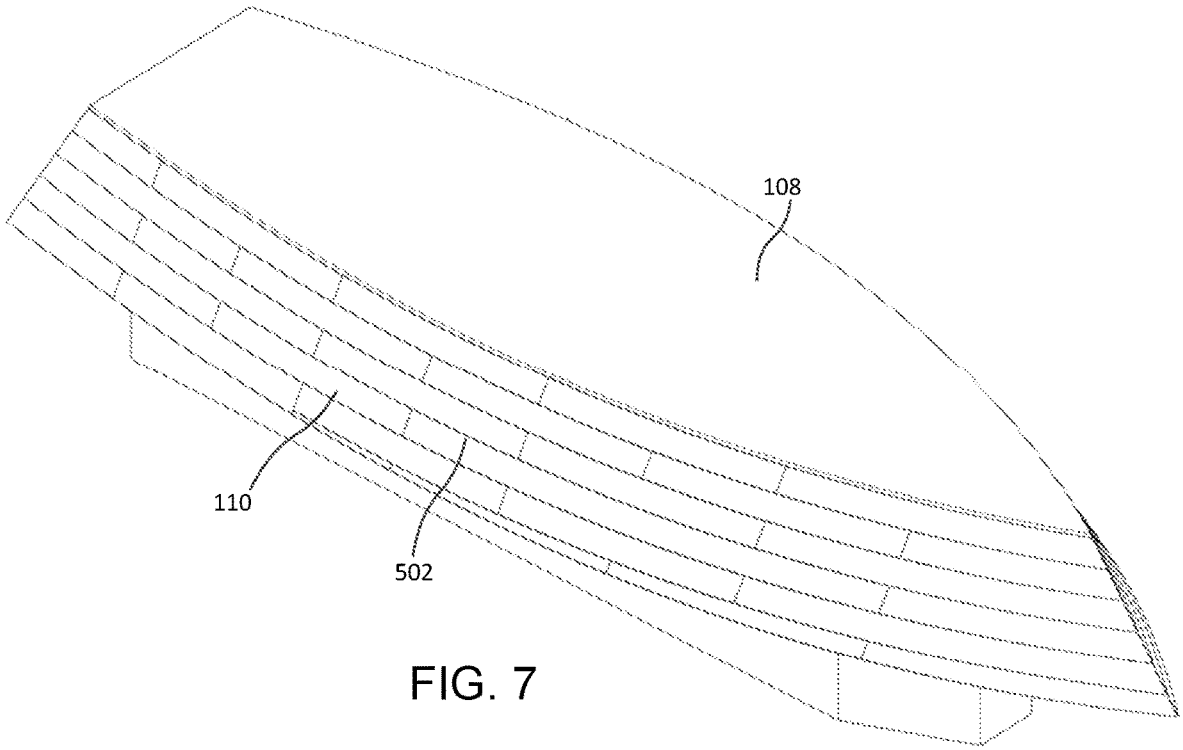

The foam component forming the bottom 108 is also added, as shown in FIG. 7. In the present example, the foam component that forms the bottom 108 is a single foam component. Alternatively, the bottom 108 may be formed utilizing two or more foam components.

Figure 8:
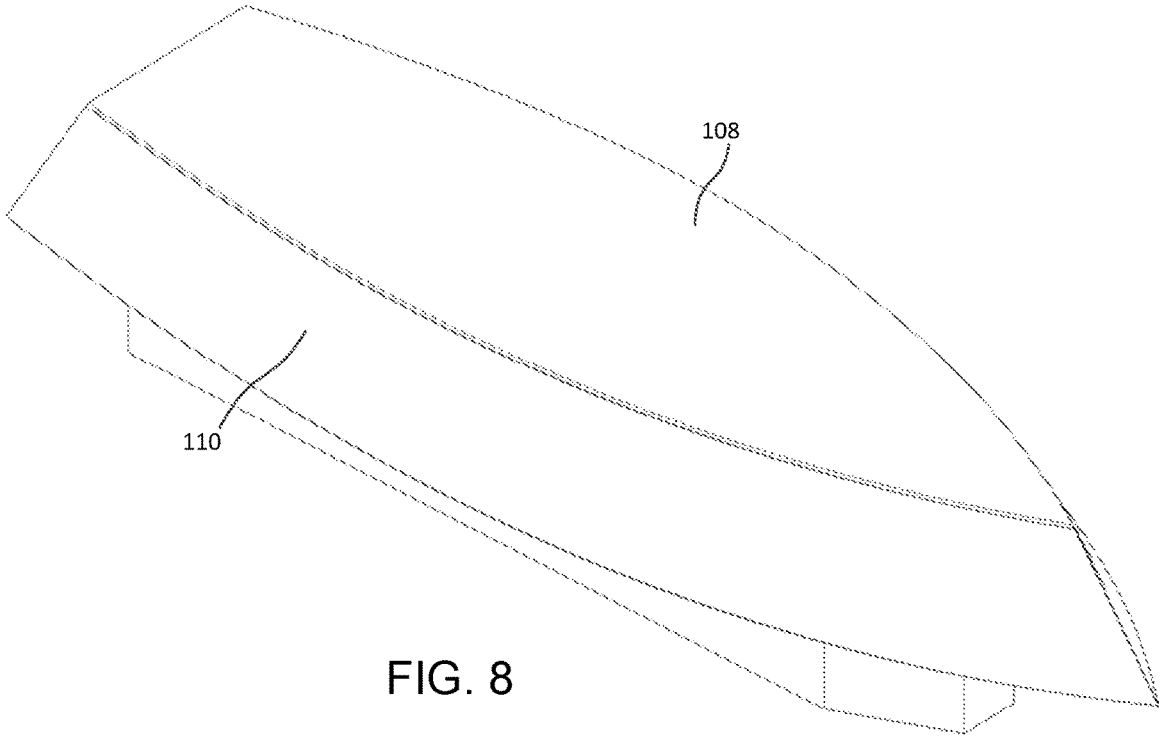
Figure 9:
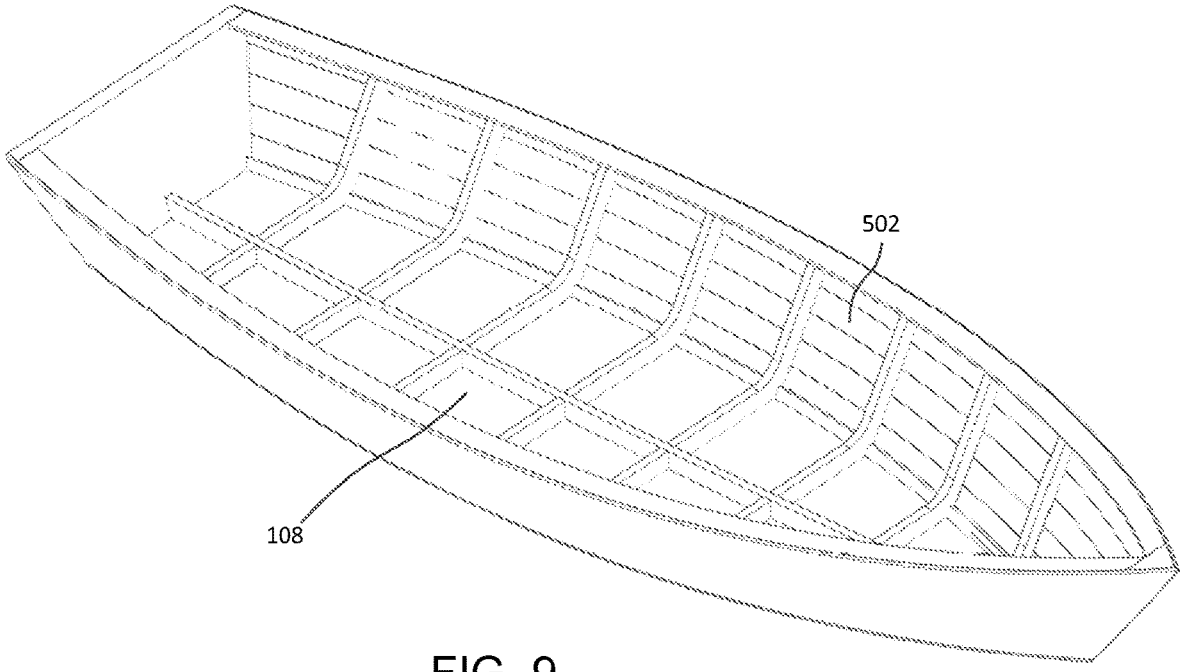
Figure 10:
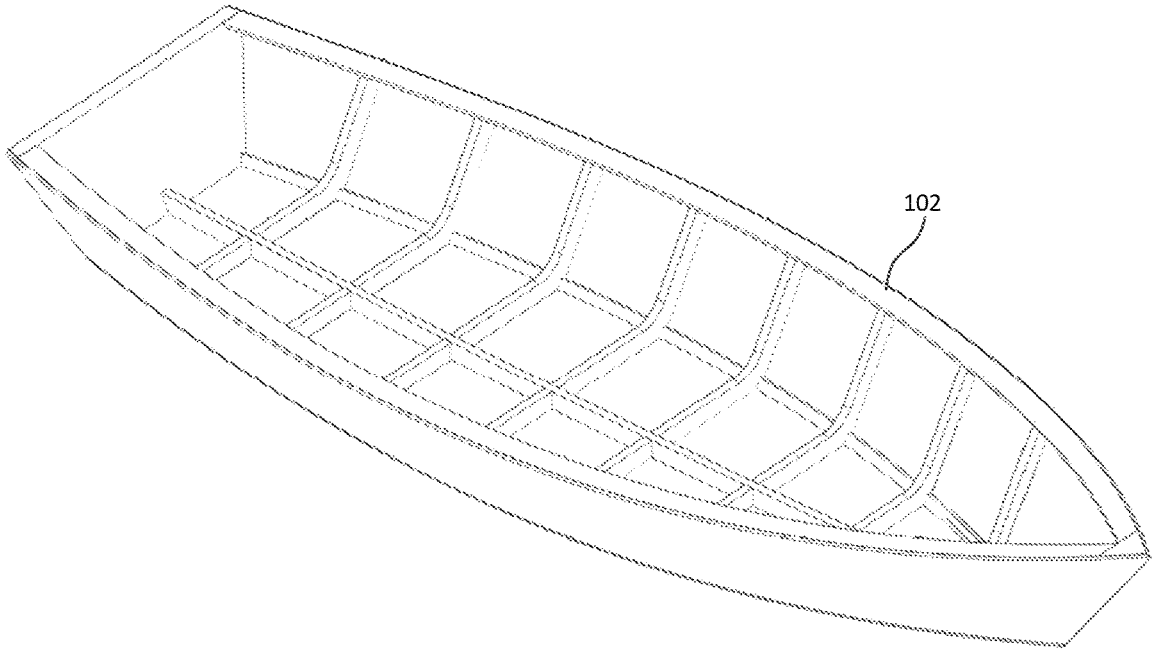

After arranging the foam components as shown, polyurea is applied to the foam components at 206, bonding the components together and covering the outer surfaces of the hull, as shown in FIG. 8. After curing, the hull 102 may be turned over as illustrated in FIG. 9 and polyurea is applied to the interior surfaces as shown in FIG. 10, thus providing the composite material forming the hull 102 of the boat shown in FIG. 1. The polyurea is applied at the intersections of the foam components and to exposed surfaces of the foam components. Thus, the planks 502 are bonded together and bonded to the cross-members 104 and stringers 108. The foam components forming the bottom are also bonded to the remainder of the body. The polyurea therefore bonds the foam components together and is also applied to the exposed surfaces of the foam components to provide a composite layer over the body.

The bench seats 120 shown in FIG. 1 may also be foam core components coupled to the sides 110, 112. The bench seats 120 may coated with polyurea, cured, and then fixed to the sides using appropriate fasteners. Alternatively, the foam core of the bench seats 120 may be fixed to the sides by polyurea applied at the intersections of the foam cores of the bench seats 120 and the sides 110, 112, in which case the polyurea is also applied to exposed surfaces of the foam core.

In the above example, the foam components including the cross-members and stringers, as well as the planks, the bottom of the hull, and the transom are arranged and glued, followed by the application of polyurea. For a larger hull, for example, polyurea may be applied to the stringers and cross-members at 206 before the planks that form the sides and the bottom are arranged relative to the other foam components. In this alternative example, the shape of the hull is not complete at 208 and the process continues at 204 where the planks that form the sides are added and glued together and the bottom of the hull is added.

Thus, the polyurea may be applied in more than one pass as the outer surface is coated with polyurea after the planks and bottom are added. After curing, the body is turned over to spray the interior, including the inner sides of the planks and the bottom, with polyurea, providing the skin layer over the interior of the body and resulting in the hull.

Advantageously, the present method is utilized to provide a relatively lightweight body with high strength and high impact resistance. The polyurea also provides a suitable seal over the foam making the method suitable for manufacturing boat hulls or other marine bodies or structures. A jig or a stand may be utilized to facilitate arrangement of the foam components in the appropriate positions and locations to form the body. No mold is required, however.

In the example described above, the entire hull 102 is made of foam spray coated with polyurea. Optionally, parts of the body may be constructed using, for example, wood or other suitable materials to which the foam may be added.

Figure 11:
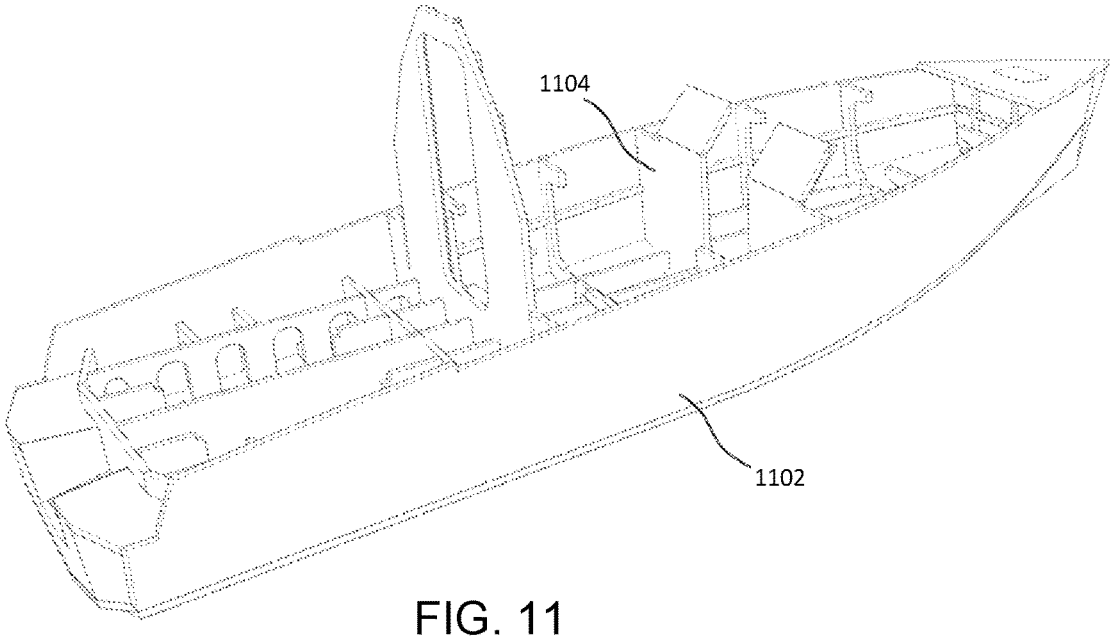
FIG. 11 is a perspective view of another example of a hull of a boat manufactured in accordance with an aspect of an embodiment.

Referring now to FIG. 11, another example of a hull of a boat is shown. The hull 1102 shown in FIG. 11 is significantly different in structure, size, and shape and includes, for example, bulkheads 1104. Although a much larger and more complex body, the method described above with reference to FIG. 2 may be successfully implemented to manufacture the hull 1102. Thus, the method is not limited to a particular size or shape of hull.

Figure 12A:
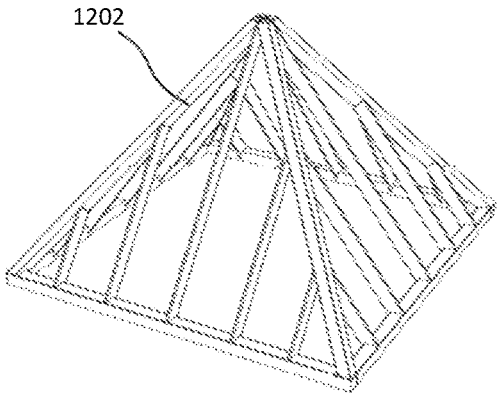
FIG. 12A through FIG. 12C show perspective views of another example of a structure at various stages in the method of manufacturing in accordance with an aspect of an embodiment.
Figure 12B:
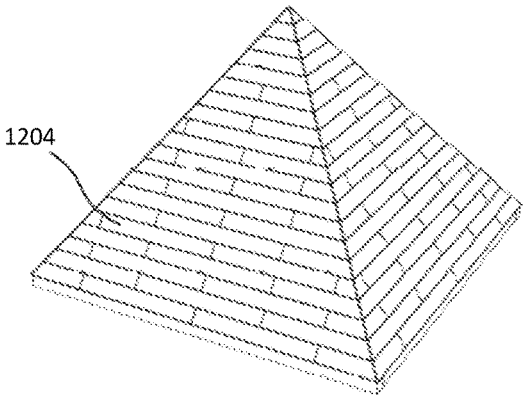
Figure 12C:
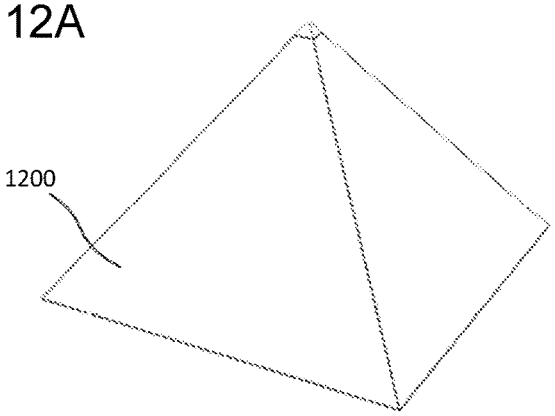

FIG. 12A through FIG. 12C show perspective views of another example of a structure at various stages in the method of manufacturing in accordance with an aspect of an embodiment. Many of the details described above with reference to FIG. 1 through 11 are similar and are not described again here in detail with reference to FIG. 12A through FIG. 12C.

In this example, the structure may be utilized in construction, for example, in a non-marine application. FIG. 12A illustrates a frame 1202 that includes foam components that are shaped to provide frame members, followed by arranging and gluing the frame members. Additional foam components, which in this example, are planks 1204 are added as illustrated in FIG. 12B to form the sides. Polyurea is applied to the foam components, bonding the components together and covering the surfaces, providing the composite material forming the structure 1200 shown in FIG. 12C. The polyurea is applied at the intersections of the foam components and to exposed surfaces of the foam components. Thus, the frame members and planks are bonded together. After applying the polyurea to an outside, for example, the structure may be inverted and polyurea is applied to an inside of the structure.

The described embodiments are to be considered as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. A method of manufacturing a body of a structure, the method comprising:

arranging and joining foam components of the body such that each one of the foam components abuts and is joined to at least one other of the foam components to form a shape;

applying polyurea in a first pass in which the polyurea is applied along intersection lines of the foam components thereby bonding the foam components together, and a second pass in which the polyurea is applied to cover a surface of the shape, wherein the polyurea is applied such that the polyurea permeates at least an outer layer of the foam components providing a composite material forming the body of the structure.

2. The method according to claim 1, wherein arranging and joining the foam components comprises hot gluing the foam components to hold the shape prior to applying the polyurea.

3. The method according to claim 1, comprising shaping the foam components including one or more of Computer Numerical Control (CNC) machining, saw cutting, hot-wire cutting and thermoforming of the foam components prior to arranging.

4. The method according to claim 1, wherein the foam components include foam stringers, foam cross members, and foam planks.

5. The method according to claim 4, wherein the foam planks form an outer surface of the shape.

6. The method according to claim 5, wherein ends of the planks are staggered along a length of the shape such that the ends of the planks are out of alignment with each other.

7. The method according to claim 1, wherein the foam comprises a polyvinyl chloride foam.

8. The method according to claim 5, comprising applying polyurea to the foam stringers and foam cross members prior to arranging the foam planks to form the outer surface of the shape, and wherein applying polyurea along intersection lines of the foam components and covering the surface of the shape comprises applying the polyurea to the outer surface of the shape.

9. The method according to claim 1, wherein arranging the foam components and applying polyurea comprises arranging first foam components and applying the polyurea to the first foam components followed by arranging second foam components and applying the polyurea to the second foam components, thereby bonding the first components and the second components together and providing the composite material.

10. The method according to claim 1, wherein the structure comprises a boat.

11. A method of manufacturing a hull of a boat, the method comprising:

arranging and joining foam elements including foam cross members, foam stringers, and foam planks into a shape of a hull such that each one of the foam elements abuts and is joined to at least one other of the foam elements;

applying polyurea along intersection lines of the foam elements including the foam cross members, the foam stringers, and the foam planks in the shape of the hull and covering a surface of the shape of the hull, wherein the polyurea is applied such that the polyurea permeates at least an outer layer of the foam elements, thereby bonding the components together and providing a composite material forming the hull of the boat.

12. The method according to claim 11, wherein arranging and joining the foam elements comprises hot gluing the foam elements to hold the shape prior to applying the polyurea.

13. The method according to claim 11, comprising shaping the foam elements including one or more of Computer Numerical Control (CNC) machining, saw cutting, hot-wire cutting and thermoforming of the foam elements prior to arranging.

14. The method according to claim 11, wherein the foam planks form an outer surface of the shape of the hull.

15. The method according to claim 11, wherein ends of the planks are staggered along a length of the hull such that the ends of the planks are out of alignment with each other.

16. The method according to claim 11, wherein the foam comprises a polyvinyl chloride foam.

17. A boat hull comprising:

foam elements including foam cross members, foam stringers, and foam planks forming a core of a hull with each one of the foam elements abutting at least one other of the foam elements, wherein the foam elements are bonded together utilizing polyurea, at least an outer layer of the foam elements permeated with the polyurea and forming a composite material.

18. The boat hull according to claim 17, wherein the foam planks are arranged on the foam stringers and foam cross members, with ends of the foam planks staggered along a length of the hull such that the ends of the foam planks are out of alignment with each other.

19. The boat hull according to claim 17, wherein the foam elements comprises a polyvinyl chloride foam.

20. The method according to claim 1, further comprising:

after applying the polyurea in the second pass, turning the body of the structure over and applying polyurea to an opposing side of the body.

* * * * *